US011332684B2

(12) United States Patent
Leal et al.

(10) Patent No.: US 11,332,684 B2
(45) Date of Patent: May 17, 2022

(54) ALCOHOL AND ETHER FUEL ADDITIVES FOR LEAD-FREE GASOLINE

(71) Applicants: SABIC GLOBAL TECHNOLOGIES B.V., Bergen op Zoom (NL); SAUDI ARABIAN OIL COMPANY, Dhahran (SA)

(72) Inventors: Guillermo Leal, Riyadh (SA); Kareemuddin M. Shaik, Dhahran (SA); Mohammed Bismillah Ansari, Riyadh (SA); Hassan Babiker, Dhahran (SA); Somak Paul, Riyadh (SA); Kamalakar Gunda, Riyadh (SA)

(73) Assignees: SABIC GLOBAL TECHNOLOGIES B.V., Bergen op Zoom (NL); SAUDI ARABIAN OIL COMPANY, Dhahran (SA)

( * ) Notice: Subject to any disclaimer, the term of this patent is extended or adjusted under 35 U.S.C. 154(b) by 160 days.

(21) Appl. No.: 16/487,222

(22) PCT Filed: Feb. 24, 2018

(86) PCT No.: PCT/IB2018/051167

§ 371 (c)(1),
(2) Date: Aug. 20, 2019

(87) PCT Pub. No.: WO2018/154524

PCT Pub. Date: Aug. 30, 2018

(65) Prior Publication Data

US 2021/0139803 A1 May 13, 2021

Related U.S. Application Data

(60) Provisional application No. 62/463,966, filed on Feb. 27, 2017.

(51) Int. Cl.

| | |
|---|---|
| ***C10L 10/10*** | (2006.01) |
| ***C10L 1/182*** | (2006.01) |
| ***C10L 1/185*** | (2006.01) |

(52) U.S. Cl.

CPC ..... *C10L 10/10* (2013.01); *C10L 1/1824* (2013.01); *C10L 1/1852* (2013.01); *C10L 2200/0423* (2013.01); *C10L 2230/22* (2013.01); *C10L 2270/023* (2013.01); *C10L 2300/40* (2013.01)

(58) Field of Classification Search

CPC ..... C10L 10/10; C10L 1/1824; C10L 1/1852; C10L 2200/0423; C10L 2230/22; C10L 2270/023; C10L 2300/40

See application file for complete search history.

(56) References Cited

U.S. PATENT DOCUMENTS

| | | | | |
|---|---|---|---|---|
| H1305 | H * | 5/1994 | Townsend | 44/448 |
| 8,193,402 | B2 | 6/2012 | Gruber et al. | |
| 2002/0078622 | A1* | 6/2002 | Rix | C07C 41/42 44/447 |
| 2013/0303806 | A1* | 11/2013 | Winterberg | C07C 1/20 203/99 |
| 2015/0240179 | A1 | 8/2015 | Xu et al. | |

FOREIGN PATENT DOCUMENTS

| | | | | |
|---|---|---|---|---|
| CN | 102911019 | A | 2/2013 | |
| CN | 105296016 | A | 2/2016 | |
| EP | 0745576 | | 12/1996 | |
| EP | 1199296 | | 4/2002 | |
| EP | 3105199 | B1 * | 5/2019 | C10G 50/00 |
| WO | 8605776 | | 10/1986 | |

OTHER PUBLICATIONS

China Search Report for CN Application No. 201880010445.4; English Translation; International Filing Date Feb. 24, 2018; dated Nov. 17, 2020; 3 pages.

International Search Report for International Application No. PCT/IB2018/051167; international filing date: Feb. 24, 2018; dated May 25, 2018; 6 pages.

Rankovic, Nikola et al., "Understanding octane number evolution for enabling alternative low RON refinery streams and octane boosters as transportation fuels" Fuel 150 (2015) 41-47.

Written Opinion of The International Searching Authority for International Application No. PCT/IB2018/051167; International filing date: Feb. 24, 2018; dated May 25, 2018; 13 pages.

* cited by examiner

*Primary Examiner* — Latosha Hines
(74) *Attorney, Agent, or Firm* — Cantor Colburn LLP

(57) ABSTRACT

An octane-enhancing additive includes a mixed butanol composition, sec-butyl ether, methanol, methyl tert-butyl ether, and a C4-dimer, the mixed butanol composition comprising sec-butanol and tert-butanol, and the C4-dimer comprising di-isobutylene, 2,2,4 trimethylpentane, 2,3,3 trimethylpentane, or a combination comprising at least one of the foregoing.

14 Claims, No Drawings

ALCOHOL AND ETHER FUEL ADDITIVES FOR LEAD-FREE GASOLINE

CROSS REFERENCE TO RELATED APPLICATIONS

This application is a National Stage application of PCT/IB2018/051167, filed Feb. 24, 2018, which claims the benefit of U.S. Provisional Application No. 62/463,966, filed Feb. 27, 2017, both of which are incorporated by reference in their entirety herein.

BACKGROUND

This application relates to fuel additives for a gasoline, a gasoline comprising the additives, and methods of making the gasoline.

Commercial gasoline, which is fuel for internal combustion engines, is a refined petroleum product that is typically a mixture of hydrocarbons (base gasoline), additives, and blending agents. Additives and blending agents are added to the base gasoline to enhance the performance and the stability of gasoline, for example octane boosters.

When used in high compression internal combustion engines, gasoline has the tendency to "knock." Knocking occurs when combustion of the air/fuel mixture in the cylinder does not start off correctly in response to ignition because one or more pockets of air/fuel mixture pre-ignite outside the envelope of the normal combustion front. Anti-knocking agents, also known as octane boosters, reduce the engine knocking phenomenon, and increase the octane rating of the gasoline. Prior octane boosters such as tetraethyl lead and methylcyclopentadienyl manganese tricarbonyl (MMT) have been or are being phased out for environmental, health, or other reasons.

Preferred compounds in present use for formulating octane boosters include C4 oxygenate compounds such as methyl tert-butyl ether (MTBE), ethyl tert-butyl ether (ETBE), and n-butanol and its isomers. However, the production and storage of the large quantities of these materials at oil refineries can be costly. In addition, limitations on the use of high concentrations of additives by regulatory mandate increase the difficulty and expense of refining operations that produce high-octane fuels. There is a need for a fuel additive or fuel that has an octane rating that is comparable to gasoline and that has increased combustion efficiency.

In view of the foregoing, there remains a need to provide cost-effective octane-enhancing compositions, and gasoline compositions including the octane-enhancing compositions.

BRIEF DESCRIPTION

Disclosed, in various embodiments, are octane-enhancing additives, gasoline compositions comprising the octane-enhancing additives, and methods of making the gasoline compositions.

An octane-enhancing additive includes a mixed butanol composition, sec-butyl ether, methanol, methyl tert-butyl ether, and a C4-dimer, the mixed butanol composition comprising sec-butanol and tert-butanol, and the C4-dimer comprising di-isobutylene, 2,2,4 trimethylpentane, 2,3,3 trimethylpentane, or a combination comprising at least one of the foregoing.

A gasoline composition includes a base gasoline and an octane-enhancing composition disclosed herein.

A method for preparing the gasoline composition includes combining a base gasoline and an octane-enhancing composition disclosed herein to form a gasoline composition.

A method for preparing a gasoline composition includes combining a base gasoline with a mixed butanol composition, sec-butyl ether, methanol, methyl tert-butyl ether, and a C4-dimer, the mixed butanol composition comprising sec-butanol and tert-butanol, and the C4-dimer comprising di-isobutylene, 2,2,4 trimethylpentane, 2,3,3 trimethylpentane, or a combination comprising at least one of the foregoing The above described and other features are exemplified by the following detailed description.

DETAILED DESCRIPTION

Described herein are a novel combination of oxygenate additives, octane-enhancing compositions comprising the novel combination of oxygenate additives, and gasoline compositions comprising the novel octane-enhancing composition. It has been found by the inventors that a gasoline composition comprising the novel octane-enhancing composition disclosed herein is characterized by increased octane number, providing better combustion and improved performance in internal combustion engines, particularly for the automotive market. In particular, the gasoline compositions comprising the novel combination of oxygenate additives can provide better performance properties compared to gasoline compositions containing ethanol, MTBE, or butanol as the sole oxygenate additive.

The terms "fuel oxygenates," "gasoline oxygenates" and simply "oxygenates" refer to a class of gasoline additives that contain one or more oxygen atoms and are effective to improve the octane rating of gasoline by increasing the oxygen content of the gasoline. Most oxygenates are either alcohols or ethers, for example methanol (MeOH), ethanol (EtOH), isopropyl alcohol (IPA), n-propyl alcohol (NPrOH), isobutanol (IBA), n-butanol (BuOH), sec-butyl alcohol (SBA), tert-butyl alcohol (TBA) or gasoline grade tert-butyl alcohol (GTBA), tert-amyl alcohol (TAA) or tert-pentanol, methyl tert-butyl ether (MTBE), ethyl tert-butyl ether (ETBE), tert-amyl methyl ether (TAME), tert-amyl ethyl ether (TAEE), tert-hexyl methyl ether (THEME), and diisopropyl ether (DIPE). These oxygenates can be produced by any known and acceptable chemical and biological reactions that are known in the art, for example, chemical reaction between isobutylene and methanol or ethanol to produce MTBE or ETBE respectively, microbial fermentation of sugars to produce bio-ethanol, and the like. Production processes can further include purification, distillation, or dehydration steps to increase purity and to remove water.

The novel combination of oxygenate additives comprises a mixed butanol composition, sec-butyl ether, methanol, methyl tert-butyl ether, and a C4-dimer.

The mixed butanol composition comprises sec-butanol and tert-butanol. The relative ratio of sec-butanol to tert-butanol can vary widely, for example a volume ratio of sec-butanol:tert-butanol of 1:99 to 99:1, or 10:90 to 90:10, or 20:80 or 80:20, or 30:70 to 70:30. In an embodiment, the volume ratio of sec-butanol:tert-butanol is 2:1 to 3:1. The preferred volume ratio is 2.4:1. The mixed butanol composition can further comprise n-butanol, isobutanol, or a combination thereof. The amount of n-butanol, isobutanol, or combination thereof can be 1 to 90 volume percent (vol. %), 1 to 80 vol. % or 1 to 70 vol. %, or 1 to 60 vol. %, or 1 to 50 vol. %, or 1 to 40 vol. %, or 1 to 30 vol. %, or 1 to 20 vol. %. In in an embodiment, the amount of n-butanol, isobutanol, or combination thereof is 84 vol. %

The C4-dimer comprises di-isobutylene; 2,2,4 trimethylpentane; 2,3,3 trimethylpentane; or a combination comprising at least one of the foregoing. There is no particular restriction on the relative amounts of each of the foregoing components in the C4-dimer composition.

The mixed butanol composition, sec-butyl ether, methanol, methyl tert-butyl ether, and C4-dimer can be added to a base gasoline to form a gasoline composition. The mixed butanol composition, sec-butyl ether, methanol, methyl tert-butyl ether, and C4-dimer can each be added individually to the base gasoline.

Alternatively, at least two of the mixed butanol composition, sec-butyl ether, methanol, methyl tert-butyl ether, and C4-dimer can be blended to form a premixed octane-enhancing additive. In some embodiments, the mixed butanol composition, sec-butyl ether, methanol, methyl tert-butyl ether, and C4-dimer are blended in a single octane-enhancing composition. The octane-enhancing composition can subsequently be added to a base gasoline to obtain a gasoline composition.

Accordingly, the octane-enhancing composition comprises a mixed butanol composition, sec-butyl ether, methanol, methyl tert-butyl ether, and a C4-dimer. The mixed butanol composition can be present in the octane-enhancing composition in an amount of 2 to 35 vol. %, or 3 to 29 vol. %, or 0.6 to 30 vol. %. The C-4 dimer can be present in the octane-enhancing composition in the range of 0.1 to 3 vol. % or 0.19 to 2 vol. %. Methanol can be present in the octane-enhancing composition in an amount of 0.4 vol. % to 2 vol. %, or 0.50 vol. % to 0.9 vol. %, or 0.55 vol. % to 0.80 vol. %. MTBE can be present in the octane-enhancing composition an amount of 65 to 99.8 vol. %, or 68 to 99.3% vol. %, or 70 to 95 vol. %. Each of the foregoing amounts is based on the total volume of the octane-enhancing composition, i.e., the total volume of the mixed butanol composition, sec-butyl ether, methanol, methyl tert-butyl ether, and C4-dimer.

The octane-enhancing composition or components thereof can be added directly to the base gasoline. However, the octane-enhancing composition or components thereof can be diluted with a substantially inert, normally liquid organic diluent such as mineral oil, naphtha, benzene, toluene, or xylene, to form an additive concentrate. These concentrates can comprise 0.1 to 80% by weight, or about 1% to 80% by weight, or 10% to 80% by weight, of the octane-enhancing composition and can contain, in addition, one or more other additives known in the art as described below. Concentrations such as 15%, 20%, 30% or 50% or higher can be used. The concentrates can be prepared by combining the desired components in any order at any temperature, for example at 23 to 70° C.

Also disclosed is a gasoline composition comprising a base gasoline and an octane-enhancing composition disclosed herein. In the gasoline composition, the base gasoline is present in an amount of 60 to 97 vol. % preferably 65 to 95 vol. %, more preferably 70 to 90 vol. %. The octane-enhancing composition can be present in the gasoline composition in an amount of 3 to 40 vol. %, preferably 5 to 35 vol. %, preferably 10 to 30 vol. %, each based on the total volume of the gasoline composition.

The gasoline composition can be prepared by combining a base gasoline and the components of an octane-enhancing composition disclosed herein, either separately or in any combination.

The mixed butanol composition can be present in the gasoline composition in a total amount of 0.5 to 20 vol. %, preferably 0.7 to 10 vol. %, more preferably 0.8 to 5 vol. %, each based on the total volume of the gasoline composition.

The methanol can be present in the gasoline composition in a total amount of 0.02 to 0.3 vol. %, preferably 0.04 to 0.25 vol. %, more preferably 0.08 to 0.20 vol. %, each based on the total volume of the gasoline composition.

The sec butyl ether and the methyl tert-butyl ether can be present in the gasoline composition in a total amount of 0.02 to 30 vol. %, preferably 0.06 to 26 vol. %, each based on the total volume of the gasoline composition.

The C4-dimer can be present in the gasoline composition in an amount of 0.01 to 2 vol. %, preferably 0.04 vol. % to 1 vol. %, each based on the total volume of the gasoline composition.

The octane-enhancing composition can further comprise other additives known in the art, for example anti-foam agents, anti-icing agents, additional anti-knock agents, anti-oxidants, anti-wear agents, color stabilizers, corrosion inhibitors, detergents, dispersants, dyes, extreme pressure agents, lead scavengers, metal deactivators, pour point depressing agents, upper-cylinder lubricants, viscosity improvers, and the like. The amounts of such additives depend on the particular additive, and can be readily determined by one of ordinary skill in the art.

Anti-foam agents used to reduce or prevent the formation of stable foam include silicones or organic polymers. Anti-oxidants, corrosion inhibitors, and extreme pressure agents are exemplified by chlorinated aliphatic hydrocarbons, organic sulfides and polysulfides, phosphorus esters including dihydrocarbon and trihydrocarbon phosphites, molybdenum compounds, and the like. Other anti-oxidants alkylated diphenyl amines, hindered phenols, especially those having tertiary alkyl groups such as tertiary butyl groups in the position ortho to the phenolic —OH group, and the like.

Detergents and dispersants can be of the ash-producing or ashless type. The ash-producing detergents are exemplified by oil-soluble neutral and basic salts of alkali or alkaline earth metals with sulfonic acids, carboxylic acids, phenols, or organic phosphorus acids characterized by a least one direct carbon-to-phosphorus linkage. Ashless detergents and dispersants can yield a nonvolatile residue such as boric oxide or phosphorus pentoxide upon combustion, but do not ordinarily contain metal and therefore does not yield a metal-containing ash on combustion. Examples include reaction products of carboxylic acids (or derivatives thereof) containing 34 to 54 carbon atoms with nitrogen containing compounds such as amine, organic hydroxy compounds such as phenols and alcohols, and/or basic inorganic materials.

Viscosity improvers are usually polymers, for example polyisobutenes, poly(methacrylic acid esters), hydrogenated diene polymers, polyalkyl styrenes, esterified styrene-maleic anhydride copolymers, hydrogenated alkenylarene-conjugated diene copolymers, and polyolefins.

In particular, the octane-enhancing composition can further comprise other oxygenate compounds, for example other alcohol, esters, or ether oxygenates. Examples of other alcohols that can be included are ethanol, isopropyl alcohol, n-propyl alcohol, tert-amyl alcohol, or a combination comprising at least one of the foregoing, Examples of other ethers that can be included are ethyl tert-butyl ether, tert-amyl methyl ether, tert-amyl ethyl ether, tert-hexyl methyl ether, diisopropyl ether, or a combination comprising at least one of the foregoing. Examples of esters that can be included are isoamyl acetate, amyl acetate, isoamyl propionate, isoamyl nonanoate, isobutyl acetate, methyl butyrate, methyl caproate, methyl caprylate, or a combination comprising at least one of the foregoing. These additional oxygenate compounds can be present in an amount of 0.02 to 20 vol. %, or 0.1 to 10 vol. %, each based on the total volume of the gasoline composition.

Other anti-knock additives include xylene, benzene, toluene, aniline, and the like.

The gasoline composition can be characterized as having a Reid vapor pressure (RVP) of 6.0 to 8.0 psi, preferably 6.5 to 7.8. The gasoline composition can also be characterized as having a research octane number (RON) higher than the RON of the base gasoline and a motor octane number (MON) higher than the MON of the base gasoline. For example, the gasoline composition can have a RON of 88 to 110, preferably 90 to 105, and a MON of 82 to 105.

This disclosure is further illustrated by the following examples, which are non-limiting.

EXAMPLES

Example 1 Gasoline Blends with Fuel Additives

Various potential additives selected from alcohols, ethers, or C4-dimers are added to a base gasoline which has the properties shown in Table 1 below. The composition of each gasoline blend is provided in Tables 2 and 3.

TABLE 1

Typical Physical Properties of Base gasoline

| Test | Method | Result |
|---|---|---|
| Density @ 15.0° C.(kg/L) | ASTM D4052 | 0.7580 |
| RVP | ASTM D323 | 6.39 psi |
| Doctor Test | ASTM D4952 | +ive |
| Oxygenates | ASTM D4815 | Not Detected |
| Total Aromatics (FIA) | ASTM D1319 | 36.0 vol. % |
| Total Aromatics (GC) | ASTM D5580 | 35.68 vol. % |
| Olefins (FIA) | ASTM D1319 | 7.98 vol. % |
| RON | ASTM D2699 | 89.5 |

Reid Vapor Pressure (RvP), research octane number (RON), and motor octane number (MON) are measured for each blend.

RvP is a measure of the volatility of gasoline. It is defined as the absolute vapor pressure exerted by a liquid (e.g., gasoline) at 100° F. (37.8° C.) as determined by test method ASTM D 323.

RON describes the knocking behavior at a low engine load and low rotational speeds and is determined according to DIN EN ISO 5164 (ASTM D 2699).

MON describes the behavior at a high engine load and under high thermal stress and is determined according to DIN EN ISO 5163 (ASTM D 2700).

Results of the tests for the base gasoline and each of the blends are tabulated in Tables 2 and 3 below.

TABLE 2

RvP, RON and MON of gasoline blends

| Alcohols | | | Ethers | | | | | | |
|---|---|---|---|---|---|---|---|---|---|
| Sec-Butyl Alcohol | Ter.-Butyl Alcohol | Methanol | Di-Sec-Butyl Ether | Methyl-Tertiary-Butyl Ether | Hydrocarbon Di-iso-Butylene | Base Gasoline | RvP | RON | MON |
| 0 | 0 | 0 | 0 | 0 | 0 | 100 | 6.39 | 89.5 | 81.5 |
| 0.00 | 0.00 | 0.04 | 0.00 | 4.96 | 0.00 | 95 | 6.39 | 91.3 | 84.1 |
| 0.00 | 0.00 | 0.08 | 0.00 | 9.93 | 0.00 | 90 | 6.59 | 92.6 | 84.3 |
| 0.00 | 0.00 | 0.11 | 0.00 | 14.89 | 0.00 | 85 | 6.67 | 94 | 84.7 |
| 0.00 | 0.00 | 0.15 | 0.00 | 19.85 | 0.00 | 80 | 6.74 | 95.1 | 85.3 |
| 2.92 | 1.22 | 0.00 | 0.60 | 0.00 | 0.26 | 95 | 6.28 | 90.3 | 82 |
| 5.84 | 2.44 | 0.00 | 1.21 | 0.00 | 0.52 | 90 | 6.24 | 90.9 | 82.6 |
| 8.76 | 3.65 | 0.00 | 1.81 | 0.00 | 0.78 | 85 | 6.23 | 91.9 | 83.4 |
| 11.68 | 4.87 | 0.00 | 2.42 | 0.00 | 1.04 | 80 | 5.97 | 93 | 84 |

TABLE 3

RvP, RON and MON of gasoline blends

| Alcohols | | | Ethers | | | | | | |
|---|---|---|---|---|---|---|---|---|---|
| Sec-Butyl Alcohol | Ter.-Butyl Alcohol | Methanol | Di-Sec-Butyl Ether | Methyl-Tertiary-Butyl Ether | Hydrocarbon Di-iso-Butylene | Base Gasoline | RvP | RON | MON |
| 0 | 0 | 0 | 0 | 0 | 0 | 100 | 6.39 | 89.5 | 81.5 |
| 0 | 0 | 0.08 | 0 | 9.93 | 0 | 90 | 6.59 | 92.6 | 84.3 |
| 0.58 | 0.24 | 0.08 | 0.12 | 9.93 | 0.05 | 89 | 6.65 | 92.6 | 84.3 |
| 1.75 | 0.73 | 0.08 | 0.36 | 9.93 | 0.16 | 87 | 6.56 | 92.8 | 84.4 |
| 2.92 | 1.22 | 0.08 | 0.60 | 9.93 | 0.26 | 85 | 6.53 | 93 | 84.4 |
| 0.00 | 0.00 | 0.11 | 0.00 | 14.89 | 0.00 | 85 | 6.67 | 94 | 84.7 |
| 0.58 | 0.24 | 0.11 | 0.12 | 14.89 | 0.05 | 84 | 6.66 | 93.7 | 84.7 |
| 1.17 | 0.49 | 0.11 | 0.24 | 14.89 | 0.10 | 83 | 6.63 | 93.8 | 84.8 |
| 1.75 | 0.73 | 0.11 | 0.36 | 14.89 | 0.16 | 82 | 6.62 | 93.9 | 84.8 |
| 2.34 | 0.97 | 0.11 | 0.48 | 14.89 | 0.21 | 81 | 6.56 | 94.1 | 84.9 |
| 2.92 | 1.22 | 0.11 | 0.60 | 14.89 | 0.26 | 80 | 6.51 | 94.3 | 84.9 |
| 0.00 | 0.00 | 0.15 | 0.00 | 19.85 | 0.00 | 80 | 6.74 | 95.1 | 85.3 |
| 0.58 | 0.24 | 0.15 | 0.12 | 19.85 | 0.05 | 79 | 6.7 | 95.1 | 85.4 |

TABLE 3-continued

| RvP, RON and MON of gasoline blends | | | | | | | | | |
|---|---|---|---|---|---|---|---|---|---|
| Alcohols | | | Ethers | | | | | | |
| Sec-Butyl Alcohol | Ter.-Butyl Alcohol | Methanol | Di-Sec-Butyl Ether | Methyl-Tertiary-Butyl Ether | Hydrocarbon Di-iso-Butylene | Base Gasoline | RvP | RON | MON |
| 1.17 | 0.49 | 0.15 | 0.24 | 19.85 | 0.10 | 78 | 6.67 | 95.3 | 85.5 |
| 1.75 | 0.73 | 0.15 | 0.36 | 19.85 | 0.16 | 77 | 6.65 | 95.5 | 85.6 |
| 2.34 | 0.97 | 0.15 | 0.48 | 19.85 | 0.21 | 76 | 6.65 | 95.6 | 85.6 |
| 2.92 | 1.22 | 0.15 | 0.60 | 19.85 | 0.26 | 75 | 6.62 | 95.8 | 85.7 |
| 0 | 0 | 0.19 | 0 | 24.81 | 0 | 75 | 6.8 | 96.7 | 86.5 |
| 0.58 | 0.24 | 0.19 | 0.12 | 24.81 | 0.05 | 74 | 6.8 | 96.7 | 86.5 |
| 1.75 | 0.73 | 0.19 | 0.36 | 24.81 | 0.16 | 72 | 6.77 | 97 | 86.5 |
| 2.92 | 1.22 | 0.19 | 0.60 | 24.81 | 0.26 | 70 | 6.72 | 97.2 | 86.6 |

This disclosure further encompasses the following aspects.

Aspect 1. An octane-enhancing composition comprising a mixed butanol composition, sec-butyl ether, methanol, methyl tert-butyl ether, and a C4-dimer, the mixed butanol composition comprising sec-butanol and tert-butanol, and the C4-dimer comprising di-isobutylene, 2,2,4 trimethylpentane, 2,3,3 trimethylpentane, or a combination comprising at least one of the foregoing.

Aspect 2. The octane-enhancing composition of aspect 1, the mixed butanol composition further comprising n-butanol, isobutanol, or a combination thereof.

Aspect 3. The octane-enhancing composition of aspect 1 or 2, wherein methanol is present in an amount of 0.4 vol. % to 2 vol. %, 0.50 vol. % to 0.9 vol. %, 0.55 vol. % to 0.80 vol. %.

Aspect 4. The octane-enhancing composition of any one or more of aspects 1 to 3 wherein methyl tert-butyl ether is present in an amount of 65 to 99.8 vol. %, 68 to 99.3% vol. %, 70 to 95 vol. %.

Aspect 5. The octane-enhancing composition of any one or more of aspects 1 to 4 wherein the mixed butanol composition is present in an amount of 2 to 35 vol. %, 3 to 29 vol. %, 0.6 to 30 vol. %.

Aspect 6. The octane-enhancing composition of any one or more of aspects 1 to 5 wherein sec-butyl ether is present in the range of 0.3 to 5 vol. %, 0.4 to 4 vol. %.

Aspect 7. The octane-enhancing composition according to any one or more of aspects 1 to 6 wherein the C-4 dimer is present in the range of 0.1 to 3 vol. %, 0.19 to 2 vol. %.

Aspect 8. The octane-enhancing composition according to any one or more of aspects 1 to 7, further comprising ethanol, isopropyl alcohol, n-propyl alcohol, tert-amyl alcohol, or a combination comprising at least one of the foregoing.

Aspect 9. The octane-enhancing composition according to any one or more of aspects 1 to 8, further comprising ethyl tert-butyl ether, tert-amyl methyl ether, tert-amyl ethyl ether, tert-hexyl methyl ether, diisopropyl ether, or a combination comprising at least one of the foregoing, Aspect 10. A gasoline composition comprising a base gasoline, and the octane-enhancing composition of any one or more of aspects 1 to 9.

Aspect 11. The gasoline composition of aspect 10 having a Reid vapor pressure (RVP) of 6.0 to 8.0 psi.

Aspect 12. The gasoline composition of aspect 10 or 11 having a research octane number (RON) higher than the RON of the base gasoline and a motor octane number (MON) higher than the MON of the base gasoline.

Aspect 13. The gasoline composition of any one or more of aspects 10 to 12 having a RON of 88 to 110 and a MON of 82 to 105.

Aspect 14. The gasoline composition of any one or more of aspects 10 to 13 wherein the mixed butanol composition and methanol are present in a total amount of 0.5 to 10 vol. %, 0.9 to 5 vol. % of the gasoline composition.

Aspect 15. The gasoline composition of any one or more of aspects 10 to 14 wherein the sec butyl ether and the methyl tert-butyl ether are present in a total amount of 0.02 to 30 vol. %, preferably 0.06 to 26 vol. % of the gasoline composition.

Aspect 16. The gasoline composition of any one or more of aspects 10 to 15 wherein the C-4 dimer is present at 0.01 to 3 vol. %, preferably 0.04 vol. % to 1 vol. % of the gasoline composition.

Aspect 17. The gasoline composition of any one or more of aspects 10 to 16 wherein the base gasoline is present at 60 to 97 vol. % preferably 65 to 95 vol. %, more preferably 70 to 90 vol. %.

Aspect 18. A method for preparing a gasoline composition, comprising combining a base gasoline and the components of the octane-enhancing composition of any one or more of aspects 1 to 9 to form a gasoline composition.

Aspect 19. The method of aspect 18, wherein the octane-enhancing composition is present in the gasoline composition in an amount of 3 vol. % to 40 vol. %, or preferably 5 vol. % to 35 vol. %, preferably 10 vol. % to 30 vol. %.

Aspect 20. The method of aspect 20, wherein the mixed butanol composition is present in the gasoline composition in a total amount of 0.5 to 20 vol. %, preferably 0.7 to 10 vol. %, more preferably 0.8 to 5 vol. %.

Aspect 21. The method of any one or more of aspects 18 to 20, wherein methanol is present in the gasoline composition in a total amount of 0.02 to 0.3 vol. %, preferably 0.04 to 0.25 vol. %, more preferably 0.08 to 0.20 vol. %.

Aspect 22. The method of any one or more of aspects 18 to 21, wherein the sec butyl ether and the methyl tert-butyl ether are present in the gasoline composition in a total amount of 0.02 to 30 vol. %, preferably 0.06 to 26 vol. % of the gasoline composition.

Aspect 23. The method of any one or more of aspects 18 to 22, wherein the C4-dimer is present in the gasoline composition in an amount of 0.01 to 2 vol. %, preferably 0.04 vol. % to 1 vol. %.

Aspect 24. A gasoline composition made by the method of any one or more of aspects 18 to 23.

The compositions and methods, and articles can alternatively comprise, consist of, or consist essentially of, any appropriate materials, steps, or components herein disclosed. The compositions, methods, and articles can additionally, or alternatively, be formulated so as to be devoid, or substantially free, of any materials (or species), steps, or components, that are otherwise not necessary to the achievement of the function or objectives of the compositions, methods, and articles.

All ranges disclosed herein are inclusive of the endpoints, and the endpoints are independently combinable with each other (e.g., ranges of "up to 25 wt. %, or, more specifically, 5 wt. % to 20 wt. %," is inclusive of the endpoints and all intermediate values of the ranges of "5 wt. % to 25 wt. %," etc.). "Combinations" is inclusive of blends, mixtures, alloys, reaction products, and the like. The terms "a" and "an" and "the" do not denote a limitation of quantity, and are to be construed to cover both the singular and the plural, unless otherwise indicated herein or clearly contradicted by context. "Or" means "and/or" unless clearly stated otherwise. Reference throughout the specification to "some embodiments," "an embodiment," and so forth, means that a particular element described in connection with the embodiment is included in at least one embodiment described herein, and may or may not be present in other embodiments. In addition, it is to be understood that the described elements may be combined in any suitable manner in the various embodiments.

All test methods cited herein are those in effect as of the priority date of this application.

Unless defined otherwise, technical and scientific terms used herein have the same meaning as is commonly understood by one of skill in the art to which this application belongs. All cited patents, patent applications, and other references are incorporated herein by reference in their entirety. However, if a term in the present application contradicts or conflicts with a term in the incorporated reference, the term from the present application takes precedence over the conflicting term from the incorporated reference.

While particular embodiments have been described, alternatives, modifications, variations, improvements, and substantial equivalents that are or may be presently unforeseen may arise to applicants or others skilled in the art. Accordingly, the appended claims as filed and as they may be amended are intended to embrace all such alternatives, modifications variations, improvements, and substantial equivalents.

What is claimed is:

1. An octane-enhancing composition comprising a mixed butanol composition, sec-butyl ether, methanol, methyl tert-butyl ether, and a C4-dimer, the mixed butanol composition comprising sec-butanol and tert-butanol, and the C4-dimer comprising at least one of di-isobutylene, 2,2,4 trimethylpentane, or 2,3,3 trimethylpentane;

wherein methanol is present in an amount of 0.70 volume percent to 2 volume percent;

wherein methyl tert-butyl ether is present in an amount of 65 to 95 volume percent;

wherein the mixed butanol composition is present in an amount of 2 to 35 volume percent; and wherein sec-butyl ether is present in the range of 0.3 to 5 volume percent.

2. The octane-enhancing composition of claim 1, the mixed butanol composition further comprising n-butanol, or isobutanol, or a combination thereof.

3. The octane-enhancing composition according to claim 1, wherein the C4-dimer is present in the range of 0.1 to 3 volume percent.

4. The octane-enhancing composition according to claim 1, further comprising at least one of ethanol, isopropyl alcohol, n-propyl alcohol, or tert-amyl alcohol.

5. The octane-enhancing composition according to claim 1, further comprising at least one of ethyl tert-butyl ether, tert-amyl methyl ether, tert-amyl ethyl ether, tert-hexyl methyl ether, or diisopropyl ether.

6. A gasoline composition comprising a base gasoline, and the octane-enhancing composition of claim 1.

7. The gasoline composition of claim 6 having a Reid vapor pressure of 6.0 to 8.0 pounds per square inch; or having a research octane number higher than the research octane number of the base gasoline and a motor octane number higher than the motor octane number of the base gasoline.

8. The gasoline composition of claim 6 having a research octane number of 88 to 110 and a motor octane number of 82 to 105.

9. The gasoline composition of claim 6 wherein the mixed butanol composition and methanol are present in a total amount of 0.5 to 10 volume percent of the gasoline composition.

10. The gasoline composition of claim 6 wherein the C4-dimer is present at 0.01 to 3 volume percent.

11. The gasoline composition of claim 6 wherein the base gasoline is present at 60 to 97 volume percent.

12. A method for preparing a gasoline composition, comprising combining a base gasoline and the components of the octane-enhancing composition of claim 1 to form a gasoline composition.

13. The method of claim 12, wherein the octane-enhancing composition is present in the gasoline composition in an amount of 3 volume percent to 40 volume percent.

14. An octane-enhancing composition comprising a mixed butanol composition, sec-butyl ether, methanol, methyl tert-butyl ether, and a C4-dimer, the mixed butanol composition comprising sec-butanol and tert-butanol, and the C4-dimer comprising at least one of di-isobutylene, 2,2,4 trimethylpentane, or 2,3,3 trimethylpentane;

wherein methanol is present in an amount of 0.9 volume percent to 2 volume percent;

wherein methyl tert-butyl ether is present in an amount of 65 to 90 volume percent;

wherein the mixed butanol composition is present in an amount of 3 to 35 volume percent; and wherein sec-butyl ether is present in the range of 0.4 to 5 volume percent; and wherein the C4-dimer is present in the range of 0.19 to 2 volume percent.

* * * * *